United States Patent [19]

Herskind

[11] 4,190,908

[45] Mar. 4, 1980

[54] CONVERTIBLE GARMENT

[76] Inventor: Boris A. Herskind, 6040 SW. 32nd St., Ft. Lauderdale, Fla. 33314

[21] Appl. No.: 855,835

[22] Filed: Nov. 30, 1977

[51] Int. Cl.[2] ..... A41D 1/14; A41D 1/06

[52] U.S. Cl. ..... 2/213; 2/227

[58] Field of Search ..... 2/227, 237, 221, 213, 2/212, 211, 71, 72, 238

[56] References Cited

U.S. PATENT DOCUMENTS

| | | | |
|---|---|---|---|
| 1,784,369 | 12/1930 | Lowenbaum | 2/72 |
| 1,794,307 | 2/1931 | Lowenbaum, Jr. | 2/72 |
| 2,080,814 | 5/1937 | Foltz | 2/72 |
| 2,744,253 | 5/1956 | Freedman | 2/72 X |
| 3,083,373 | 4/1963 | Rizzotto | 2/227 X |

FOREIGN PATENT DOCUMENTS

| | | | |
|---|---|---|---|
| 1803765 | 5/1970 | Fed. Rep. of Germany | 2/227 |
| 1363957 | 5/1964 | France | 2/227 |
| 511414 | 8/1939 | United Kingdom | 2/227 |

*Primary Examiner*—H. Hampton Hunter

[57] ABSTRACT

A convertible garment convertible to long pants that can be converted to short pants, and a skirt, to be worn separately, and if desired, convertible back to the original convertible garment, the long pants comprising a short pants having short leg enclosing sections, long leg enclosing sections, the lower edge of the long leg enclosing sections having a combined length substantially equal to the waist size length of the pants wearer, slide fasteners securing the upper edges of the long leg enclosing sections to the lower edges of the short leg enclosing sections, and slide fasteners securing the side edges of each long leg enclosing section to each other, wherein when all the fasteners are unfastened; the short pants can be assembled and secured together by the long leg enclosing section slide fasteners to provide a skirt, to be worn separately, and whose waist length is equal to the combined lengths of the long leg enclosing sections lower edges.

1 Claim, 5 Drawing Figures

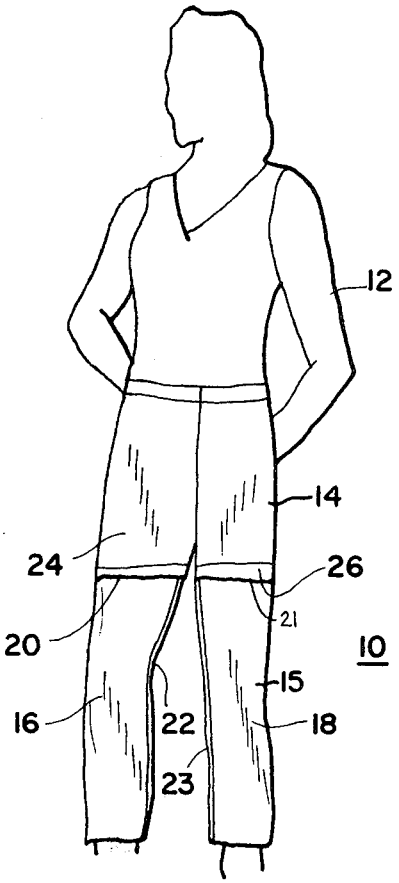
FIG. 1
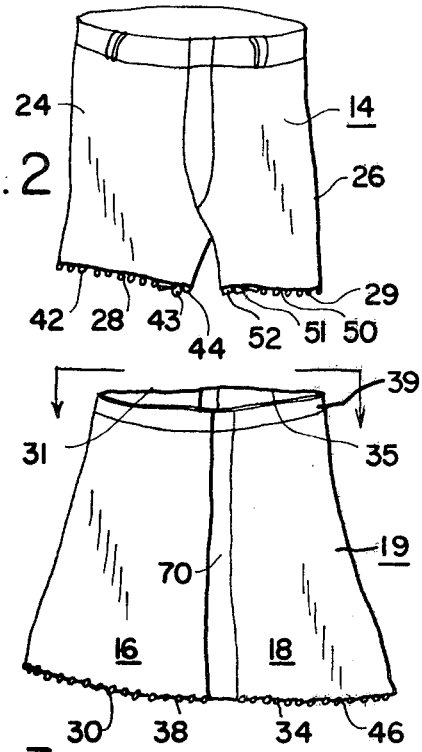
FIG. 2
FIG. 3
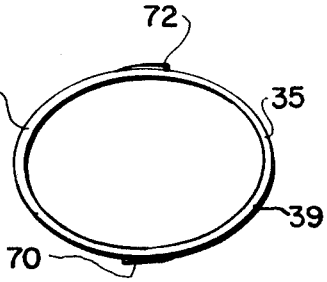
FIG. 4
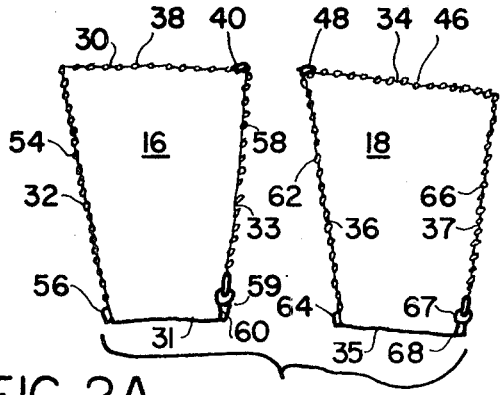
FIG. 2A

CONVERTIBLE GARMENT

BACKGROUND OF THE INVENTION

Field of the Invention

This invention relates generally to an article of clothing, and in particular, to long pants convertible to short pants, and a skirt, and back to the long pants at will.

Description of the Prior Art

In the past, a number of garments have been proposed, some of which are of the combination type, that for example, include a skirt and an under garment, which are intended to be worn together. Other prior art garment arrangements have included a single garment such as one of sack form that can be converted to a legged form to cover the wearer's legs. None of the proposed prior garments are of the type wherein a single garment can be readily converted into two other separate garments intended to be worn separately, and which can be just as readily reconverted to the single garment.

Examples of prior art garments are found in the following U.S. Pat. Nos. 1,521,228; 1,783,572; 1,794,307; 1,964,447; 2,080,814; 2,255,143; 2,519,866; 2,598,462; and 2,744,253.

SUMMARY OF THE INVENTION

Accordingly, one object of the present invention is to provide a convertible garment of new and improved construction.

Another object is to provide an article of clothing that can be converted to two other separate garments which can be converted back to the original article of clothing.

One other object is to provide long pants that can be disassembled to provide short pants, and long leg enclosing sections. The long leg enclosing sections can be assembled to provide a skirt.

These and other objects and advantages will become more apparent during the course of the following description.

BRIEF DESCRIPTION OF THE DRAWINGS

In the drawings:

FIG. 1 is a front view of the convertible garment of the present invention;

FIG. 2 is a perspective front view of the short pants of the convertible garment of FIG. 1;

FIG. 2A is a diagrammatic view of the long leg enclosing sections of the convertible garment of FIG. 1 before the edges are fastened;

FIG. 3 is a perspective front view of the skirt formed in accordance with the present invention; and FIG. 4 is a top view of the skirt of FIG. 3.

DESCRIPTION OF THE PREFERRED EMBODIMENT

Referring now to the drawings, and in particular, to FIG. 1, the convertible garment 10 of the present invention is shown worn by a wearer 12. The convertible garment 10 consists generally of short pants 14, a pair of long leg enclosing sections 16 and 18, and fasteners 20, 21, 22 and 23.

Short pants 14, best shown in FIG. 2, are conventional, and have short leg enclosing sections 24 and 26, which are provided with lower edges 28 and 29 respectively. Short pants 14 can be made from any suitable material, such as cloth, or the like.

Reference is now made to FIG. 2A wherein the details of a pair of long leg enclosing sections 16 and 18 are revealed. Long leg enclosing section 16 has upper edge 30, lower edge 31, and is divided along its length to form two side edges 32, 33. Long leg enclosing section 18 has upper edge 34, lower edge 35, and is divided along its length to form two side edges 36, 37. The lower edges 31 and 35 have a combined length which is substantially equal to the waist size length of the wearer 12, for a purpose to be more clearly apparent hereinafter. The long leg enclosing section 16 and 18 have a first mode and a second mode.

Fasteners 20, 21, 22 and 23 are all conventional slide fasteners and can be of the open end type. In the first mode, to form long pants 15 first fastener 20 secures lower edge 28 of short leg enclosing section 24 to the upper edge 30 of leg enclosing section 16. Preferably, fastener 20 has its fastening element 38 with the male couples 40 on one end suitably secured on the upper edge 30 of leg enclosing section 16, and its other fastening element 42 with slider 43 and female coupler secured to the lower edge 28 of short leg enclosing section 24. Similarly, second fastener 21 secures the lower edge 29 of short leg enclosing section 26 to the upper edge 34 of long leg enclosing section 18 by having its fastening element 46 with male coupler 48 carried by upper edge 34 of section 18, and the fastening element 50 with slider 51 and female coupler 52 carried by the lower edge 29 of short leg enclosing section 26. Side edges 32 and 33 of leg section 16 are fastened together by third fastener 22, while side edges 36 and 37 of leg section 18 are secured by the fourth fastener 23. Fastener 22 has its fastening element 54 with male coupler 56 on side edge 32 and fastening element 58 with slider 59 and female coupler 60 on sides edge 33. Similarly, fastener 23 has its fastening element 62 with male coupler 64 on side edge 36, and fastening element 66 with slider 67 and female coupler 65 on side edge 37, as shown.

In the second mode, to convert the garment 10 to the short pants 14 of FIG. 2 and the skirt 19 of FIGS. 3 and 4, wearer 12 merely unfastens fasteners 20 and 21 to separate long leg enclosing section 16 from short leg enclosing section 24 and long leg enclosing section 18 from short leg enclosing section 26 to form the short pants 14. Fasteners 22 and 23 are then unfastened to separate the side edges 32 and 33 of long leg enclosing section 16 and the side edges 36 and 37 of long leg enclosing section 18. Next, side edge 32 of section 16 is secured to side edge 37 of section 18 by inserting male coupler 56 through slider 67 into female coupler 68 and then drawing slider 67. Likewise, side edge 33 of section 16 is secured to edge 36 of section 18 by inserting male coupler 64 through slider 59 and into female coupler 60 and drawing slider 59 to form skirt 19. As a result of lower edges 31 and 35 of long leg enclosing sections 16 and 18 having a combined length substantially equal to the waist-size length of the wear 12, waistband 39 of skirt 19 has a size equal to the waist size of wearer 12.

Flap 70 carried by section 16, and flap 72 carried by section 18, best shown in FIGS. 3 and 4, can be provided to conceal fasteners 22, 23 when the garment is assembled as the long pants 15 of FIG. 1 or the skirt 19 of FIG. 3.

The above description of the presently preferred embodiment of the invention will suggest various other changes, substitutions, and other departures from the disclosure within the scope of the appended claims.

What is claimed is:

1. A convertible garment for a wearer, convertible to long patns or to short pants and a skirt, said garment comprising said short pants, a pair of long leg enclosing sections, said short pants having a pair of short leg enclosing sections, each of said long leg enclosing sections being divided along its length to form two side edges, the lower edges of said pair of said long leg enclosing sections having a combined length substantially equal to the waist size of said wearer, said pair of long leg enclosing sections having a first mode with the upper edge of one of said long leg enclosing sections secured to the lower edge of one of said short leg enclosing sections and the upper edge of the other of said long leg enclosing sections secured to the lower edge of the other of said short leg enclosing sections and said two side edges of said one long leg enclosing section secured to each other and said two side edges of said other long leg enclosing section secured to each other to form said long patns, said pair of long leg enclosing sections having a second mode with one of said side edges of said one long leg enclosing section secured to one of said side edges of said other long leg enclosing section and the other of said side edges of said one long leg enclosing section secured to the other of said side edges of said other long leg enclosing section to form said skirt, said skirt having a waistband comprising said lower edges of said long leg enclosing sections, whereby said waistband has a size equal to the waist size of said wearer.

* * * * *